US010081995B2

(12) United States Patent
Malafey et al.

(10) Patent No.: US 10,081,995 B2
(45) Date of Patent: Sep. 25, 2018

(54) WELL TOOL COMPRISING A PLUGGING DEVICE AND A JUNK CATCHING DEVICE

(71) Applicant: Interwell Technology AS, Ranheim (NO)

(72) Inventors: Anastasia Malafey, Jakobsli (NO); Jan Tore Helland, Rennesøy (NO)

(73) Assignee: INTERWELL TECHNOLOGY AS, Ranheim (NO)

( * ) Notice: Subject to any disclaimer, the term of this patent is extended or adjusted under 35 U.S.C. 154(b) by 352 days.

(21) Appl. No.: 14/906,630

(22) PCT Filed: Jun. 2, 2014

(86) PCT No.: PCT/EP2014/061329
§ 371 (c)(1),
(2) Date: Jan. 21, 2016

(87) PCT Pub. No.: WO2015/010813
PCT Pub. Date: Jan. 29, 2015

(65) Prior Publication Data

US 2016/0160596 A1 Jun. 9, 2016

(30) Foreign Application Priority Data

Jul. 24, 2013 (NO) ..... 20131042

(51) Int. Cl.
*E21B 27/00* (2006.01)
*E21B 23/01* (2006.01)
(Continued)

(52) U.S. Cl.
CPC ..... *E21B 27/00* (2013.01); *E21B 23/01* (2013.01); *E21B 33/12* (2013.01); *E21B 33/13* (2013.01)

(58) Field of Classification Search
CPC ..... E21B 27/00; E21B 23/01; E21B 33/12; E21B 33/13
See application file for complete search history.

(56) References Cited

U.S. PATENT DOCUMENTS 2,300,438 A * 11/1942 Spang ..... E21B 33/1208 166/139
2,927,644 A * 3/1960 Caldwell ..... E21B 27/00 166/117

(Continued)

FOREIGN PATENT DOCUMENTS

| | | |
|---|---|---|
| GB | 2 170 837 | 8/1986 |
| WO | 2014/079661 | 5/2014 |

OTHER PUBLICATIONS

International Search Report and Written Opinion of the International Searching Authority dated Oct. 22, 2014 in International (PCT) Application No. PCT/EP2014/061329.

(Continued)

*Primary Examiner* — James G Sayre
*Assistant Examiner* — Aaron L Lembo
(74) *Attorney, Agent, or Firm* — Wenderoth, Lind & Ponack, L.L.P

(57) ABSTRACT

A well tool including a plugging device having an inner mandrel, an anchoring device and a sealing device. The tool also includes a junk catching device having an outer housing, a bore provided inside the housing and a receiving device provided in an upper end of the housing. A lower end of the outer housing is connected to an upper end of the inner mandrel of the plugging device. The receiving device comprises a receiving opening providing an opening into the bore and a junk guiding device for guiding junk into the bore via the receiving opening. The well tool further includes a valve device having a run state and a set state, where the (Continued)

valve device forms a termination of a junk container in the set state.

6 Claims, 4 Drawing Sheets

(51) Int. Cl.
*E21B 33/12* (2006.01)
*E21B 33/13* (2006.01)

(56) References Cited

U.S. PATENT DOCUMENTS 3,107,742 A * 10/1963 Woods ..... E21B 49/02 175/309
3,227,216 A * 1/1966 Bumpers ..... E21B 27/00 166/66.5
3,378,089 A * 4/1968 Marsh ..... E21B 27/00 166/66.5
4,059,155 A * 11/1977 Greer ..... E21B 21/103 166/301
4,111,262 A * 9/1978 Duncan ..... E21B 27/00 166/162
4,276,931 A * 7/1981 Murray ..... E21B 21/103 166/169
4,390,064 A * 6/1983 Enen, Jr. ..... E21B 27/00 166/162
4,828,026 A * 5/1989 Nelson ..... E21B 27/00 166/99
5,139,089 A 8/1992 Wacker
6,341,653 B1 1/2002 Firmaniuk et al.
6,478,086 B1 * 11/2002 Hansen ..... E21B 33/02 166/250.17
6,848,507 B2 * 2/2005 Huggins ..... E21B 31/125 166/301
7,753,113 B1 * 7/2010 Penisson ..... E21B 27/00 166/162
7,798,212 B2 * 9/2010 Bolze ..... E21B 17/02 166/242.1
8,453,724 B2 * 6/2013 Zhou ..... E21B 27/00 166/99
9,784,060 B2 * 10/2017 Hiorth ..... E21B 27/00
9,816,342 B2 * 11/2017 Pedersen ..... E21B 31/00
2009/0200030 A1 8/2009 Mills
2012/0118571 A1 5/2012 Zhou
2015/0300118 A1 * 10/2015 Hiorth ..... E21B 23/01 166/99

OTHER PUBLICATIONS

Search Report dated Jan. 22, 2014 in Norwegian Application No. 20131042.

* cited by examiner

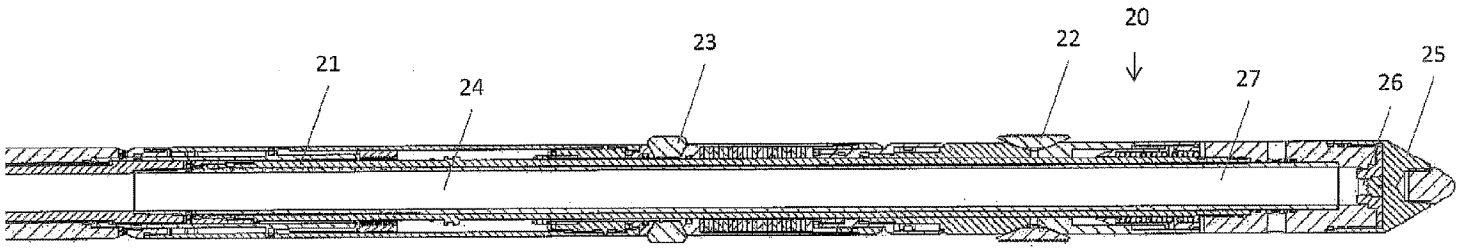
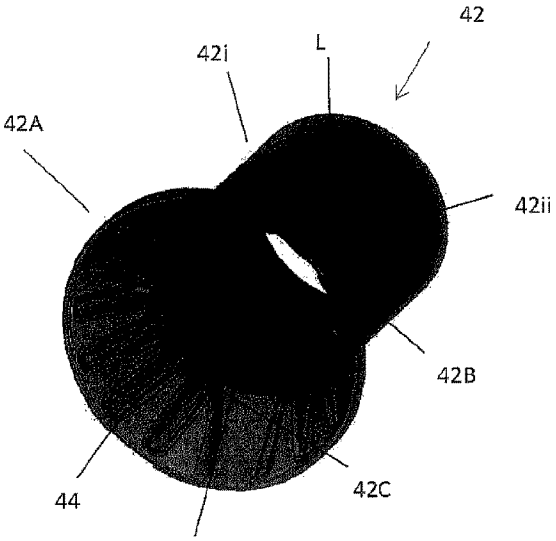
Fig. 9
Fig. 11
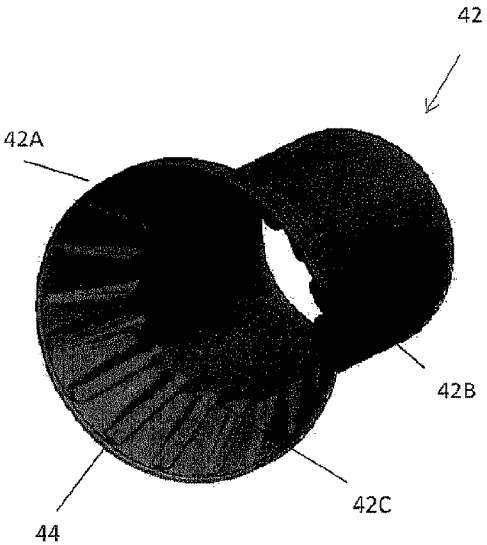
Fig. 10

WELL TOOL COMPRISING A PLUGGING DEVICE AND A JUNK CATCHING DEVICE

BACKGROUND OF THE INVENTION

Plugging devices are used in oil and/or gas wells for sealing an upper section of the well from a lower section of the well. Such plugging devices comprise one or two anchoring devices and a sealing device. The anchoring device provides anchoring of the plugging device to the inner surface of the well. The sealing device comprises a sealing element and supporting devices for sealing the upper and lower sections of the well from each other, thereby preventing fluid from passing between the sections.

The plugging device is first run into the well in a run or radially retracted state by using a setting tool. At the desired location in the well, the plugging device is set in the well by actuating the plugging device to a set or radially expanded state, in which the anchoring device and sealing element are brought into contact with the well pipe. The supporting devices are supporting the sealing element, thereby preventing extrusion of the sealing element due to the pressure difference between the upper and lower sections.

After use, the plugging device may be retrieved from the well by using a retrieval tool. First, the pressure difference between the upper and lower section of the well is equalized. Then the anchoring device and sealing device are brought to a retrieval, or radially retracted, state, in which the plugging device may be pulled out of the well. Such plugging devices are known for example US 2004194969.

Junk catching devices are also used in oil and/or gas wells for catching junk, i.e. to prevent junk such as debris, metal fragments, metal parts or other unwanted objects to travel (i.e. fall or sink) further down into the well. Such unwanted objects are often also referred to as "fish", as such objects must be fished or picked up from the well before other types of operations can be performed. If not, these objects may present obstructions which may prevent well tools from passing their location in the well.

It is known to use a junk catching device above plugging devices, such as bridge plugs, straddle packers etc. in order to prevent drilling fluid to enter the annular space between the plugging devices and the inner surface of the well pipe. Such well fluid tend to precipitate solid matter over time, and if the solid matter reaches the anchoring device or supporting devices for the sealing element of the plugging devices, then the plugging device may be difficult to retrieve from the well. Such situations may occur of it is necessary to interrupt an offshore oil/gas well due to bad weather conditions, where it may take several weeks to continue the well operation.

The problem with the use of such junk catching devices together with the plugging device is, first of all, that it requires several running operations in the well. First, the plugging device is run into the well and set, then the junk catching device is run into the well and set. During retrieval, first the retrieval tool for the junk catching device must be inserted into the well and the junk catching device must be retrieved, then the retrieval tool for the plugging device is inserted into the well and the plugging device must be retrieved.

Another problem is that well fluids and junk often will fall onto the plugging device during the retrieval of the junk catching device and during the insertion of the retrieval tool for the plugging device. Hence, the effect of the junk catching device is reduced. Consequently, a bailing operation may still be required between the retrieval of the junk catching device and the retrieval of the plugging device.

The object of the present invention is to provide a well tool where the above disadvantages are avoided. Hence, the object is to reduce the number of operations needed during setting and retrieval of the well tool, and to reduce the risk of the plugging device being stuck in the well.

SUMMARY OF THE INVENTION

The present invention relates to a well tool comprising:

a plugging device comprising an inner mandrel, an anchoring device and a sealing device;

a junk catching device comprising an outer housing, a bore provided inside the housing and a receiving device provided in an upper end of the housing;

where a lower end of the outer housing is connected to an upper end of the inner mandrel of the plugging device;

where the receiving device comprises a receiving opening providing an opening into the bore and a junk guiding device for guiding junk into the bore via the receiving opening;

where the well tool further comprises a valve device having a run state and a set state, where the valve device is forming a termination of a junk container in the set state.

In one aspect, the valve device is a flapper valve.

In one aspect, the valve device is provided in the bore within the outer housing or in a further bore provided within the inner mandrel.

In one aspect, the plugging device comprises a first connection interface, where the first connection interface is provided for connection to a first connection interface of a setting tool.

In one aspect, the junk guiding device is configured to be provided in a run state and a set state, where:

the outer diameter of a guiding section of the junk guiding device is less than the outer diameter of the housing in the run state;

the outer diameter of the guiding section of the junk guiding device is larger than the outer diameter of the housing in the set state.

In one aspect, the junk guiding device is funnel-shaped in the set state.

In one aspect, the junk guiding device is funnel-shaped when unaffected by external forces.

DETAILED DESCRIPTION

Embodiments of the invention will be described with reference to the enclosed drawings, where:

FIG. 9 illustrates the plugging device of FIG. 2 in its set state;

FIG. 10 illustrates a perspective view of the first embodiment of the junk guiding device;

FIG. 11 illustrates a perspective view of a second embodiment of the junk guiding device.

Figure 1:
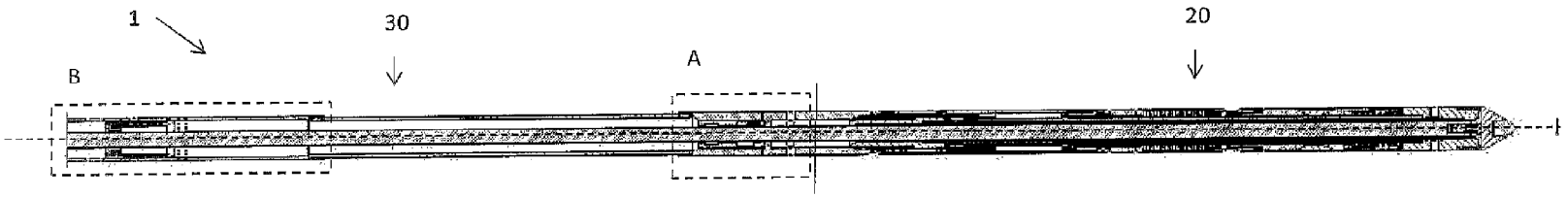
FIG. 1 illustrates a cross section of the well tool in the run state.

It is now referred to FIG. 1. Here it is shown a well tool 1 for use in an oil and/or gas well. The longitudinal direction of the tool 1 is indicated by the dashed line I. In FIG. 1, the well tool 1 comprises two main parts, a plugging device 20 and a junk catching device 30. It should be noted that the plugging device 20 is located in the lower end of the tool 1 and the junk catching device 30 is located in the upper end of the tool 1. In most operations, the tool 1 will be lowered into a vertical or inclining well with the plugging device 20 being located at a lower depth than the junk catching device 30. Hence, junk falling from a position higher up in the well will be caught by the junk catching device 30 and prevents the junk from traveling to the plugging device 20.

The well tool 1 has a run state, a set state and a retrieval state, which will be described in detail below. A setting tool 2 (FIGS. 2, 4 and 6) is used to run the tool 1 into the well and bring it from the run state to the set state at the desired location in the well. A retrieval tool 3 (FIG. 8) is used to bring the tool 1 from the set state to the retrieval state and retrieve the tool 1 out from the well after use.

Figure 2:
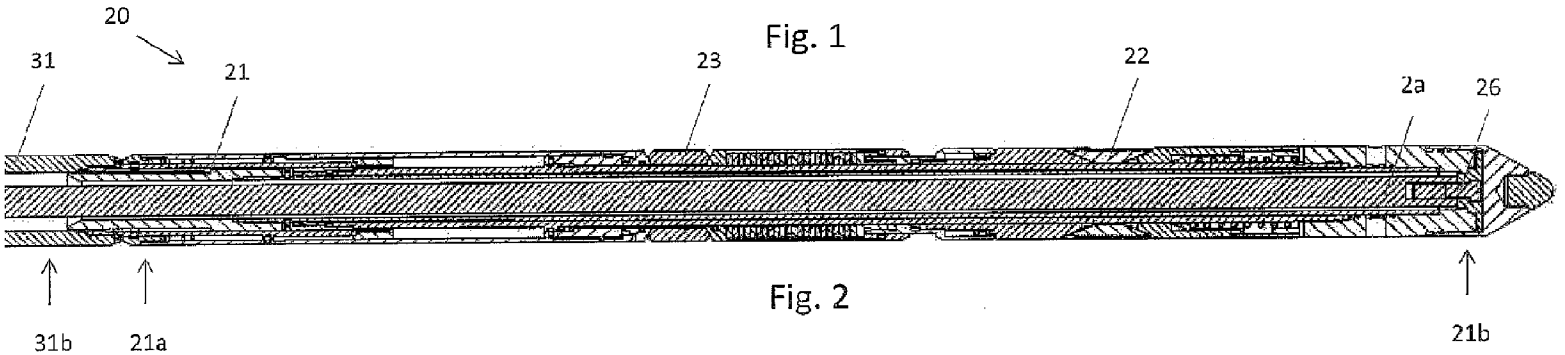
FIG. 2 illustrates the plugging device of the well tool in FIG. 1.

The plugging device 20 will now be described with reference to FIG. 2. The plugging device 20 here comprises an inner mandrel 21, an anchoring device 22 and a sealing device 23. The inner mandrel 21 has an upper end 21*a* and a lower end 21*b*. The upper end 21*a* of the inner mandrel 21 is connected to the junk catching device 30. In the present embodiment, the plugging device is comprises a bore 27, as shown in FIG. 9. The plugging device 20 also comprises a nose section 25 connected to the lower end 21*b* of the mandrel 21. A first connection interface 26 is provided in the lower end 21*b* of the mandrel 21, where the first connection interface 26 is provided for connection to a first connection interface 2*a* of the setting tool 2 (FIG. 2).

The anchoring device 22 and the sealing device 23 can be brought from a run state, in which they are radially retracted, to a set state in which they are radially expanded. The run state is shown in FIG. 2. The set state is shown in FIG. 9. In the set state the anchoring device 22 is engaged with the inner surface of the well pipe, ensuring that axial movement of the tool 1 in relation the well pipe is prevented. In the set state the sealing device 23 forms a fluid-tight seal against the inner surface of the well pipe, ensuring that fluid cannot flow from the annular space between the outside of the tool 1 and the well pipe above the sealing device 23 to the annular space between the outside of the tool 1 and the well pipe below the sealing device (or in the opposite direction). The anchoring device 22 and the sealing device 23 may also be brought from the set state to a retrieval state, in which they are radially retracted again, for retrieval of the plugging device out of the well together with the other parts of the well tool 1.

It should be noted that that plugging device 20 itself is considered to be known. Therefore, not all details of the plugging device 20 will be described in detail. The anchoring device 22 and the sealing device may for example be as described in the above-mentioned US 2004194969.

Figure 3:
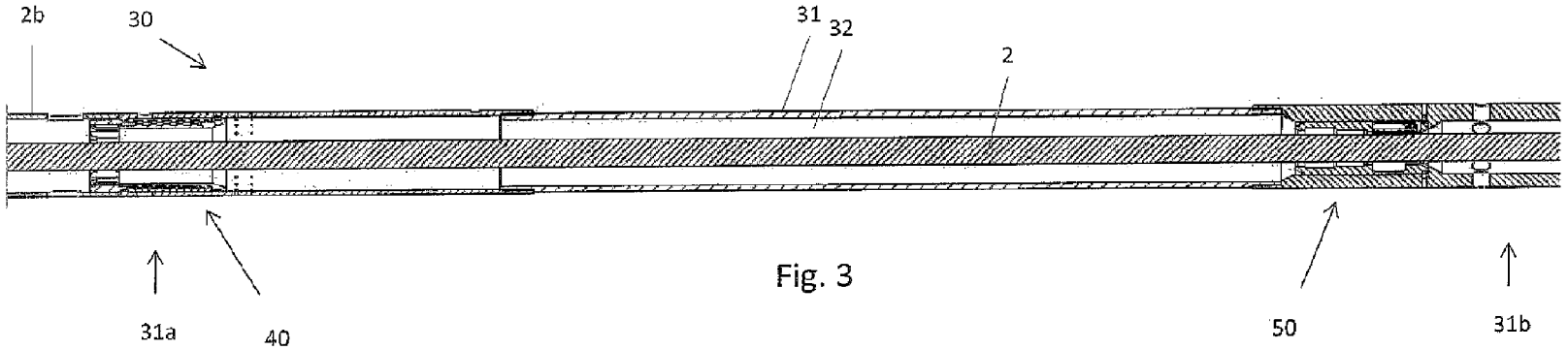
FIG. 3 illustrates the junk catching device of the well tool in FIG. 1.

The junk catching device 30 will now be described with reference to FIG. 3. The junk catching device 30 comprises an outer housing 31, a bore 32 provided inside the housing 31 and a receiving device 40. The housing 31 has an upper end 31*a* and a lower end 31*b*. The receiving device 40 is provided in the upper end 31*a* of the housing 31. The lower end 31*b* of the outer housing 31 is connected to the upper end 21*a* of the inner mandrel 21 of the plugging device 20.

Figure 6:
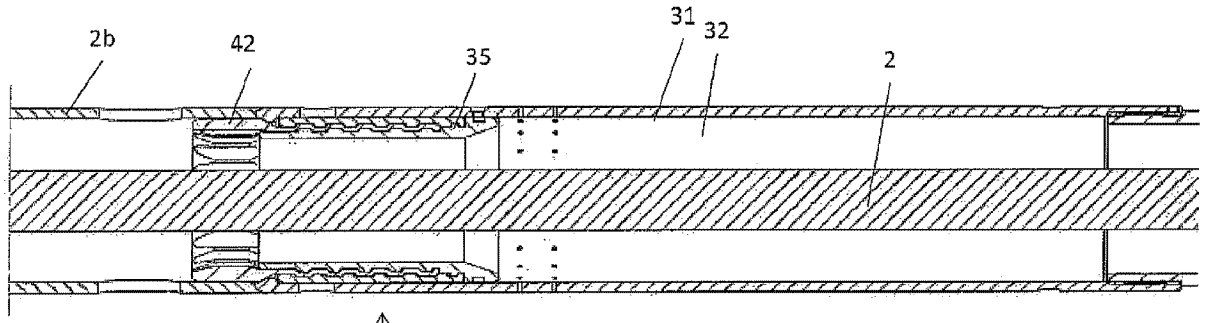
FIG. 6 illustrates an enlarged view of the elements of dashed box B in FIG. 1.
Figure 7:
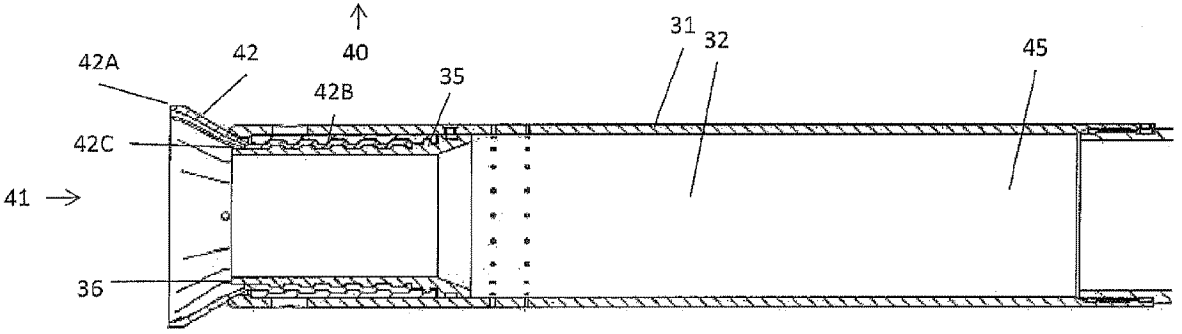
FIG. 7 illustrates the element of FIG. 6 in the set state.
Figure 8:
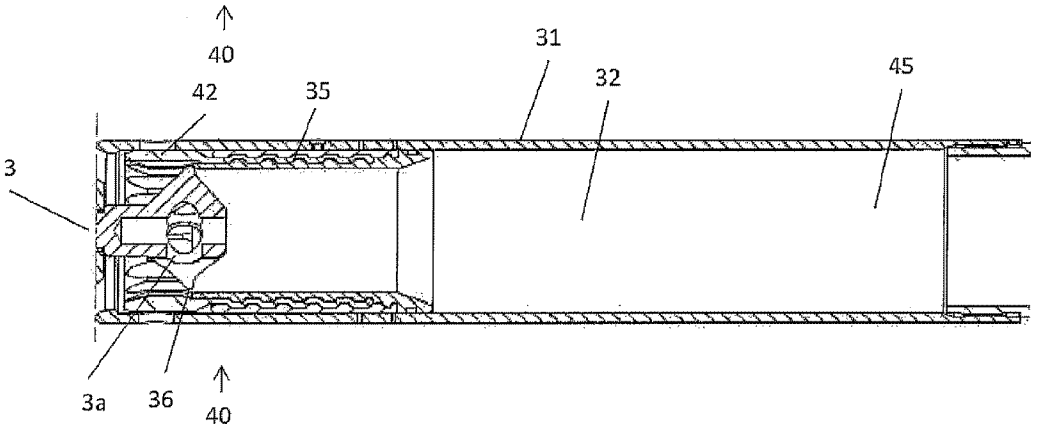
FIG. 8 illustrates the elements of FIG. 6 in the retrieved state.

Details of the receiving device 40 are shown in FIGS. 6, 7 and 8.

The receiving device 40 comprises a receiving opening 41 (FIG. 7) which provides an opening into the bore 32 and a junk guiding device 42 for guiding junk into the bore 32 via the receiving opening 41.

The junk guiding device 42 is configured to be provided in a run state (FIG. 6), a set state (FIG. 7) and a retrieval state (FIG. 8).

The junk guiding device 42 comprises a guiding section 42A and an attachment section 42B. The outer diameter of the guiding section 42A of the junk guiding device 42 is less than the outer diameter of the housing 31 in the run state. In FIG. 6 it is shown that the guiding section 42A is located inside an outer housing 2*b* of the setting tool. The outer diameter of the guiding section 42A of the junk guiding device 42 is larger than the outer diameter of the housing 31 in the set state. In FIG. 7 it is shown that the junk guiding device 42 is funnel-shaped in the set state, and that the guiding section 42A forms the uppermost or outermost part of the guiding device 42. Preferably, the guiding section 42A has an outer diameter in the set state so that it is in contact with the inner surface of the pipe, in order to be able to guide every piece of junk into the bore 32, thereby preventing junk from passing the outside of the housing 31 and further down to the plugging device.

A bending area 42C is defined between the guiding section 42A and the attachment section 42B. The junk guiding device 42 is in the present embodiment made of a semi-rigid material, such as short-aramid-fibre reinforced rubber material, carbon, aramid and/or textile fibre reinforced rubber material, plate spring material, thermosetting plastic or thermoplastic material, fibre fabric materials or similar materials.

A bending area 42C is defined between the guiding section 42A and the attachment section 42B. The junk guiding device 42 is in the present embodiment made of a semi-rigid material, such as short-aramid fiber reinforced rubber material, carbon, aramid and/or textile fiber reinforced rubber material, plate spring material, thermosetting plastic or thermoplastic material, fiber fabric materials or similar materials.

The flexibility of the material of the junk guiding device 42 makes it possible to compress the junk guiding device 42 into a substantially cylindrical shape, as shown in FIG. 6. Here, the guiding section 42A is compressed into a substantially cylindrical shape while the attachment section 42B maintains its original shape of a cylinder. However, when the junk guiding device 42 is unaffected by external forces, it will return to its initial funnel-shape.

Preferably, the guiding section 42A is molded into a funnel-shaped body having a diameter slightly larger than the expected inner surface of the well pipe in order to apply a pressure towards the inner surface of the well pipe.

The junk catching device 30 further comprises a sleeve device 35. The sleeve device 35 is fixed to the attachment section 42B of the junk guiding device 42. The sleeve device 35 is axially displaceable within the bore 31 of the outer housing 30. In FIGS. 6 and 7 it is shown that the attachment section 42B is corrugated and fixed to the sleeve device 35.

Figure 4:
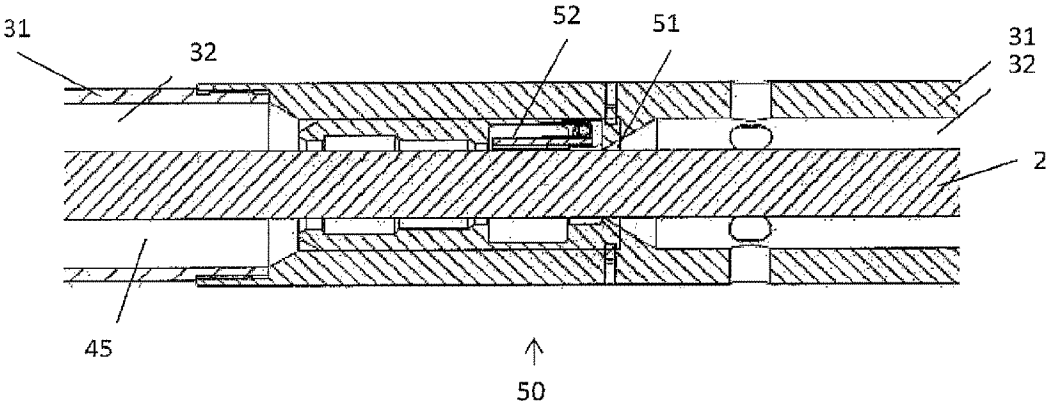
FIG. 4 illustrates an enlarged view of the elements of the dashed box A in FIG. 1.
Figure 5:
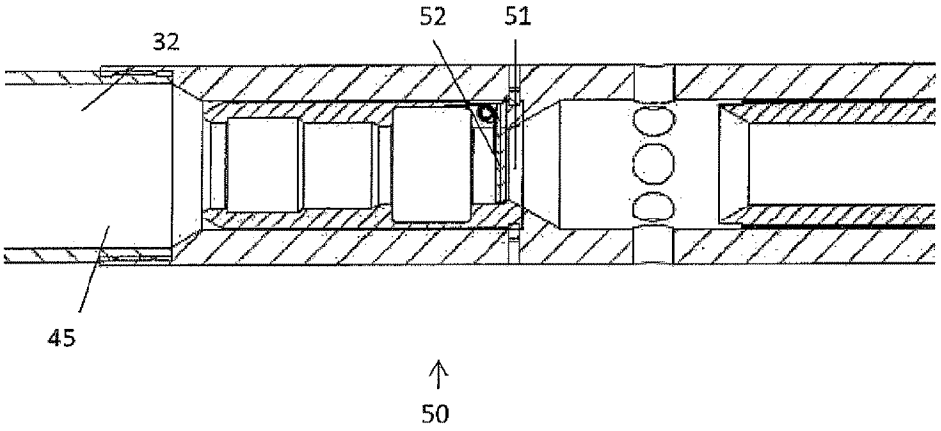
FIG. 5 illustrates the elements of FIG. 4 in the set state.

The well tool 1 further comprises a valve device 50. The valve device 50 also has a run state, a set state and a retrieval state. In the run state, the valve device 50 is held open, and in the set and retrieval states, the valve device 50 is held closed. The valve device 50 forms a termination of a junk container 45 in the set and retrieval states. By the term "termination", it is meant that the valve device 50 forms the lowermost closed part of the junk container 45, i.e. the bottom or end of the junk container 45. By the term "junk container" it is meant the interior compartment of the tool 1 wherein junk will be contained. In FIGS. 4 and 5 it is shown that the junk container 45 is formed by the bore 32 down to the termination formed by the closed valve device 50. It should be noted that in an alternative embodiment, the valve device 50 could be provided in a further bore 24 provided within the inner mandrel 21. In this case the junk container 45 will be formed by the entire bore 32 and the further bore 24 down to the termination formed by the closed valve device 50.

In the present embodiment, the valve device 50 is a flapper valve with an opening 51 and a lid 52 for closing the opening 51. The opening 51 is sufficiently large to give access to the setting tool 2, so that the setting tool 2 can be inserted through the opening 51 and further down to the connection interface 26 in the lower end of the tool 1. The valve device 50 may for example be spring biased, so that the lid 52 closes the opening 51 automatically when the setting tool 2 is removed from the opening 51 of the valve device 52.

The operation of the well tool 1 will now be described. In the run state, the innermost and lower part 2*a* of the setting tool 2 is connected to the connection interface 26, as shown in FIG. 2. The outer housing 2*b* of the setting tool 2 is contact with the upper part 31*b* of the housing 31, as shown in FIG. 3. Moreover, the outermost and upper part 2*b* of the setting tool 2 is provided radially outside the guiding section 42A, thereby compressing the guiding section 42A junk guiding device 42 into a substantially cylindrical shape.

In this state, the tool 1 is guided to the desired location in the well. The setting tool 2 is now actuated to bring the tool 1 from the run state to the set state. In the present embodiment, this is performed by pulling the innermost and lower part 2*a* of the setting tool 2 upwardly (to the left in the drawings) and/or pushing the outermost and upper part 2*b* of the setting tool 2 downwardly. The relative axial movement between the upper and lower parts 2*a*, 2*b* will cause a relative axial movement between the outer housing 31 and the inner mandrel 21, thereby causing the anchoring device 22 and the sealing device to radially expand to their set state, as shown in FIG. 9. Now, the plugging device 20 and hence the tool 1 is anchored to the inner surface of the well pipe.

The setting tool 2 is now disconnected from the connection interface 26 and the outer housing 31 by pulling the setting tool 2 upwardly. The lower end 2*a* may for example be connected to the connection interface 21 by means of shear pins which break when the upwardly directed pulling force of the setting tool 2 exceeds a certain limit.

When the outer housing 2*b* is pulled up from the guiding section 42A, the guiding section 42A will expand to its set state, in which the junk guiding device 42 is substantially funnel-shaped, as described above and which is shown in FIG. 7.

In addition, the removal of the setting tool 2 will cause the valve device 50 to close, as shown in FIG. 5.

If there are no damages to the inner surface of the well, the junk guiding device 42 will seal against the entire circumference of the inner surface of the well, and thereby guiding junk through the opening 41 and further into the junk container 45 in an efficient way, i.e. no junk will be able to pass the area between the junk catching device 40 and the inner surface of the well. Hence, the anchoring device 23 and sealing device 22 will be protected from junk.

The well tool 1 may be retrieved from the well. A retrieval tool 3 is used for this operation. First the retrieval tool 3 is lowered into the well. The retrieval tool 3 comprises a circular interface 3*a* configured to contact an upper end rim 36 of the sleeve device 35. Moreover, the pulling tool 3 comprises a fish neck device (not shown) for connection to the upper end 31*a* of the outer housing 31. The fish neck device and its connection to the housing 31 are considered to be known for a person skilled in the art.

Hence, by using the fish neck device to prevent downward movement of the outer housing 31 and by using the circular interface 3*a* to push the sleeve device 35 down, the junk guiding device 42 together with the sleeve 35 is pushed down into the outer housing 31. Consequently, the junk guiding device 42 is brought into its retrieval state in which the guiding section 42A is substantially cylindrical again.

By pulling the circular interface 3*a* further upwards after entering the upper end of the housing 31, also the anchoring device and sealing device are radially retracted to their retrieval state, and the tool 1 may be pulled out from the well.

In FIG. 10, a perspective view of the above described junk guiding device 42 is shown. Here, it is also shown that the junk guiding device 42 may comprise supporting elements 44 incorporated in material of the upper part of the junk guiding device 42, in order to maintain the funnel shape of the junk guiding device 42 in the set state. In this embodiment, the junk guiding device 42 is provided as one, single body.

A perspective view of an alternative embodiment of the junk guiding device 42 is illustrated in FIG. 11. Here, the junk guiding device 42 is provided as two bodies 42*i*, 42*ii*, which are assembled into the junk guiding device 42 shown in FIG. 11. A separation line L is indicating the separation between the two bodies 42*i*, 42*ii*. In this way it is achieved that one type of junk guiding device 42 may be used in tools with different diameters.

The invention claimed is:

1. A well tool for use in an oil and/or gas well, comprising:

a plugging device for providing sealing of an upper section of the well from a lower section of the well, where the plugging device comprises an inner mandrel, an anchoring device for anchoring of the plugging device to an inner surface of the well and a sealing device for sealing the upper and lower sections of the well from each other, thereby preventing fluid from passing between the sections;

a junk catching device connected to an upper end of the inner mandrel of the plugging device;

wherein:

the junk catching device comprises an outer housing, a bore provided inside the outer housing and a receiving device provided in an upper end of the outer housing;

a lower end of the outer housing is connected to an upper end of the inner mandrel of the plugging device;

the receiving device comprises a receiving opening providing an opening into the bore and a junk guiding device for guiding junk into the bore via the receiving opening;

the well tool further comprises a valve device having a run state and a set state, where the valve device is a flapper valve forming a termination of a junk container in the set state;

the junk guiding device is configured to be provided in a run state, in which the junk guiding device is cylindrical, a set state, in which the junk guiding device is funnel-shaped, and a retrieval state, in which junk guiding device is substantially cylindrical again;

the outer diameter of a guiding section of the junk guiding device is less than the outer diameter of the outer housing in the run state;

the outer diameter of the guiding section of the junk guiding device is larger than the outer diameter of the outer housing in the set state and where the outer diameter of the guiding section is having a diameter larger than the expected inner surface of the well pipe in order to apply a pressure towards the inner surface of the well pipe.

2. A well tool according to claim 1, where the valve device is provided in the bore within the outer housing or in a further bore provided within the inner mandrel.

3. A well tool according to claim 2, where the plugging device comprises a first connection interface, where the first connection interface is provided for connection to a first connection interface of a setting tool.

4. A well tool according to claim 1, where the plugging device comprises a first connection interface, where the first connection interface is provided for connection to a first connection interface of a setting tool.

5. A well tool according to claim 1, where the junk guiding device is funnel-shaped and compressible into a substantially cylindrical shape.

6. A well tool according to claim 1, where the junk catching device is a device for catching junk falling down into the well.

* * * * *